US008972246B2

(12) United States Patent
Park et al.

(10) Patent No.: US 8,972,246 B2
(45) Date of Patent: Mar. 3, 2015

(54) METHOD OF EMBEDDING DIGITAL INFORMATION INTO AUDIO SIGNAL MACHINE-READABLE STORAGE MEDIUM AND COMMUNICATION TERMINAL

(71) Applicant: Samsung Electronics Co., Ltd., Gyeonggi-do (KR)

(72) Inventors: Kyong-Ha Park, Gyeonggi-do (KR); Sergey Zhidkov, Izhevsk (RU); Hyun-Su Hong, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 333 days.

(21) Appl. No.: 13/707,093

(22) Filed: Dec. 6, 2012

(65) Prior Publication Data

US 2013/0151241 A1 Jun. 13, 2013

(30) Foreign Application Priority Data

Dec. 7, 2011 (RU) ..... 2011149716

(51) Int. Cl.
*G10L 19/00* (2013.01)

(52) U.S. Cl.
USPC ..... 704/200.1; 704/502; 704/200

(58) Field of Classification Search
USPC ..... 704/500–504, 200, 200.1, 205, 211
See application file for complete search history.

(56) References Cited

U.S. PATENT DOCUMENTS

2011/0125508 A1* 5/2011 Kelly et al. ..... 704/502
2011/0144979 A1 6/2011 Jung et al.
2012/0203561 A1* 8/2012 Villette et al. ..... 704/500

OTHER PUBLICATIONS

A secure, robust watermark for multimedia, Lecture Notes in Computer Science, vol. 1174/1996, pp. 185-206.
Echo Hiding, Proceedings of the First International Workshop on Information Hiding, Cambridge, UK, pp. 293-315.

* cited by examiner

*Primary Examiner* — Huyen X. Vo
(74) *Attorney, Agent, or Firm* — The Farrell Law Firm, P.C.

(57) ABSTRACT

A method for embedding digital information into an audio signal, is provided. The method includes dividing the digital information into low-priority data and high-priority data; dividing the audio signal into first and second signal parts; embedding at least one echo signal into the first signal part; embedding a communication signal modulated with low-priority data, which has a spectrum according to psychoacoustic analysis of the second signal part, into the second signal part; and combining the embedded first and second signal parts.

10 Claims, 8 Drawing Sheets

METHOD OF EMBEDDING DIGITAL INFORMATION INTO AUDIO SIGNAL MACHINE-READABLE STORAGE MEDIUM AND COMMUNICATION TERMINAL

PRIORITY

This application claims priority under 35 U.S.C. §119(a) to Russian Application Serial No. 2011149716, which was filed in the Russian Patent Office on Dec. 7, 2011, the entire content of which is hereby incorporated by reference.

BACKGROUND OF THE INVENTION

1. Field of the Invention

The present invention relates generally to processing digital signals, and more particularly, to a method for embedding digital information into an audio or sound signal in telecommunication systems.

2. Description of the Related Art

It is well known that sound waves are used in a data communication. The use of sound waves in telecommunication relates to short range data communication that does not use wireless or optical communication hidden to an observer. An example may be the use of a sound communication for exchanging digital information among mobile devices. One of the major advantages in the case of using such a communication type is that an upgrade of a conventional communication device is not required and typically only additional software is needed.

Various methods for solving problems associated with sound communication are disclosed in the conventional art. One of the methods for embedding an unobtrusive signal with digital information into an audio track is to add a spread spectrum signal having a level lower than a zero level to an audio signal as described by I. J. Cox, J. Kilian, T. Leighton and T. Shamoon, "A Secure, Robust Watermark For Multimedia", Lecture Notes in Computer Science, Volume 1174/1996, pp. 185-206 (1996).

Another method for solving such problems may be "echo-modulation". In this method, an echo on a low level is added to an audio signal, and the delay or the level of the echo is modulated according to digital information, as described by Gruhl. D., Lu, A, and Bender, W., "Echo Hiding," Proceedings of the First International Workshop on Information Hiding, Cambridge, UK, May 30-Jun. 1, 1996, pp. 293-315.

US Patent Publication No. 2011/0144979 discloses a method for embedding digital information in an audio signal based on multicarrier digital modulation using the psychoacoustic characteristic of a human acoustic system.

A method based on a broadband signal (also referred to as a "spread spectrum signal") with an amplitude lower than a zero level or based on digital modulation using psychoacoustic masking and a plurality of carrier waves generally has a higher data transmission rate than a method based on echo-modulation. The method undetectably embeds a digital information stream having data transmission rate of several kilobytes or more per second into an audio signal. However, due to a special characteristic of a human auditory system, such a method mainly uses high audible frequency, which provides a more noticeable frequency-time masking effect. Therefore, when a sound is transferred over the air, the high frequency quickly attenuates according to an increase in distance between a sound source and a receiver (a microphone), and in addition, the sound does not pass through a physical obstacle while transmitting the sound. As a result, such systems perform data transmission using sound over a considerably short distance (for example, 10 centimeters) and are generally applied to an application example in which a clear line-of-sight is secured between the sound source and a microphone.

Echo modulation is less sensitive to an obstacle between a sound source and a microphone and is appropriate for a data transmission through a sound over a relatively long distance (for example, several meters). On the other hand, this transmission type has defects such as a low processing rate (generally, several bits or several tens of bits per second) due to an overload of a microphone over a short distance, and sensitivity to noise and non-linear distortion.

SUMMARY OF THE INVENTION

Therefore, the embodiments of the present invention have been designed to overcome the problems and/or disadvantages occurring in the prior art, and to provide at least the advantages described below.

An aspect of the present invention is to obtain a high data transmission rate in an audio signal and to increase reception sensitivity distance with regard to the transmitted data.

According to an aspect of the present invention, a method for embedding digital information into an audio signal includes dividing the digital information into low-priority data and high-priority data; dividing the audio signal into first and second signal parts; embedding at least one echo signal into the first signal part; embedding a communication signal modulated with low-priority data, which has a spectrum according to psychoacoustic analysis of the second signal part, into the second signal part; and combining the embedded first and second signal parts.

According to another aspect of the present invention, there is provided a machine-readable storage medium containing a program for executing a method for embedding digital information into an audio signal, the method including dividing the digital information into low-priority data and high-priority data; dividing the audio signal into first and second signal parts; embedding at least one echo signal into the first signal part; embedding a communication signal modulated with low-priority data, which has a spectrum according to psychoacoustic analysis of the second signal part, into the second signal part; and combining the embedded first and second signal parts.

According to another aspect of the present invention, there is provided a communication terminal for embedding digital information into an audio signal, the communication terminal including a memory for storing the digital information and the audio signal; a controller configured to divide the digital information into low-priority data and high-priority data, divide the audio signal into first and second signal parts, embed at least one echo signal into the first signal part, embed a communication signal modulated with low-priority data, which has a spectrum according to psychoacoustic analysis of the second signal part, into the second signal part, and combine the embedded first and second signal parts; and a speaker for outputting the combined first and second signal parts.

BRIEF DESCRIPTION OF THE DRAWINGS

The above and other aspects, features, and advantages of the present invention will be more apparent from the following detailed description taken in conjunction with the accompanying drawings, in which.

DETAILED DESCRIPTION OF EMBODIMENTS OF THE PRESENT INVENTION

The present invention may be modified in various ways and it may include various embodiments. Therefore, the specific embodiments will be described in detail with reference to the accompanying drawings. However, the descriptions are not intended to limit the specific embodiments, and it should be understood to include every change, equivalent, and modification included in the idea and technical scope of the present invention.

The terms including ordinal numbers such as first and second may be used for describing various embodiments, but the embodiments are not limited by the terms. The terms are used only for the purpose of differentiating one component from another. For example, a first component may be defined as a second component without departing from the scope of the invention, and similarly the second component may be defined as a first component. The term "and/or" is defined to include a combination of a plurality of described relative components or any one of the plurality of the components.

Figure 1:
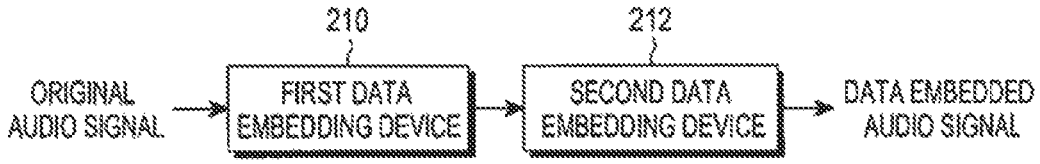
FIG. 1 illustrates a method of sequentially embedding digital information into an audio signal.

FIG. 1 illustrates a method of sequentially embedding digital information into an audio signal. In the present description, "embedding digital information into an audio signal" means to modulate or to encode the audio signal with the digital information or to add the digital information to the audio signal.

The simplest way to combine two modulation methods is to sequentially modulate audio signals according to the two methods.

A first data embedding device 210 first-modulates an original audio signal with a first data according to a first method, and a second data embedding device 212 second-modulates the first-modulated audio signal with a second data according to a second method.

However, these modulation methods have two important defects.

First, since the audio signal is deformed by two modulation methods, the data modulation by the second data embedding device 212 negatively affects the audio signal modulated by the first data embedding device 210, and causes characteristic deterioration of the restored data obtained by decoding or demodulating the second-modulated audio signal. Otherwise, the data modulation makes the restoration of the first data embedded by the first data embedding device 210 impossible. Second, since inserted distortion is overlapped or increased, the sequential modulation considerably deteriorates the quality of the original audio signal.

The present invention has been designed to prevent these negative effects. First, the transmission method based on digital modulation using a spread spectrum broadband signal or using a plurality of carrier waves is desirable, because this method provides a high data transmission rate and causes less audible audio distortion in an exact signal shaping algorithm. Therefore, echo modulation should be used only when it is not possible to depend on a transmission method based on the digital modulation using the spread spectrum signal or using a plurality of carrier waves. However, it is not possible to know in advance whether the transmission status of the audio signal allows the use of the multicarrier or spread spectrum signal modulation. In addition, in a practical example of this method, data transmission is performed in one direction, that is, without a return channel. Therefore, in a case of decreasing the efficiency of the transmission based on the multicarrier modulation (or a multicarrier digital modulation) and spread spectrum signal modulation, the decrease in efficiency generally means the distance between an audio source and a microphone has become very long.

When it is determined that echo modulation is the only way in which the information can be transmitted by an audio channel, the present invention uses an echo modulation optimized in such a condition. For this, a concept of frequency-selective echo modulation is introduced.

Figure 2A:
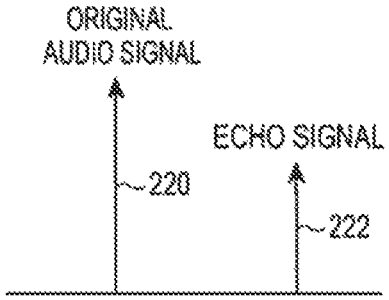
FIG.2A (PRIOR ART)
FIGS. 2A and 2B illustrate the principles of the conventional echo modulation and the frequency-selective echo modulation according to the present invention.
Figure 2B:
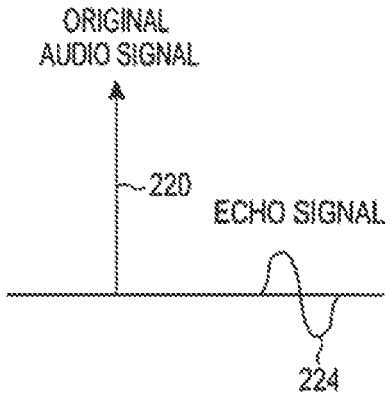

FIGS. 2A and 2B illustrate the principles of the conventional echo modulation and the frequency-selective echo modulation according to the present invention. In FIGS. 2A and 2B, a horizontal axis represents time, and a longitudinal axis represents a strength of a signal. FIG. 2A illustrates that only the strength of a time-delayed signal 222 (that is, an echo signal) is decreased as compared with the original audio signal 220, as in the prior art. As illustrated in FIG. 2B, not only the strength of a delayed signal 224 (that is, a frequency-selective echo signal) according to the present invention is decreased, but also the delayed signal 224 is linearly deformed in order to remove certain spectrum components. Alternatively, bandpass filtering may be used, but a merit of the deformation is to remove high frequency. As in the conventional method, data embedding may be performed by amplitude modulation (strength modulation) or a delay of such echoes. The frequency-selective echo signal may have a low frequency or a high frequency.

Figure 3A:
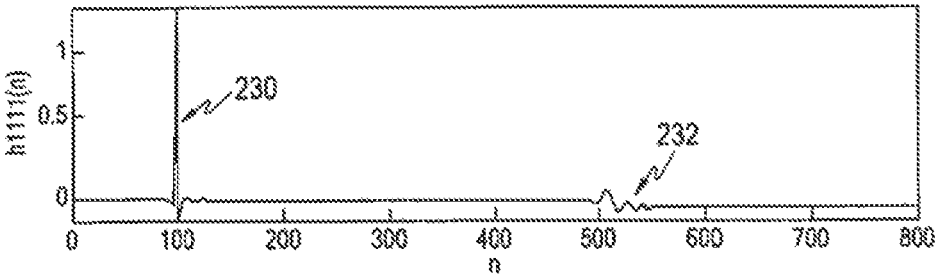
FIGS. 3A to 3C illustrate impulse responses of three frequency-selective echo filters that provide various echo delay times according to the present invention.
Figure 3B:
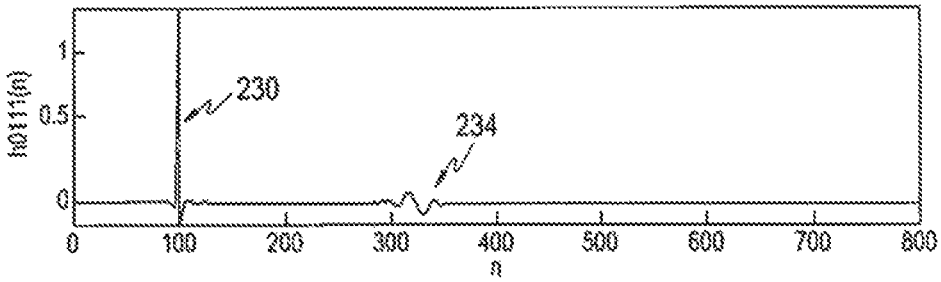
Figure 3C:
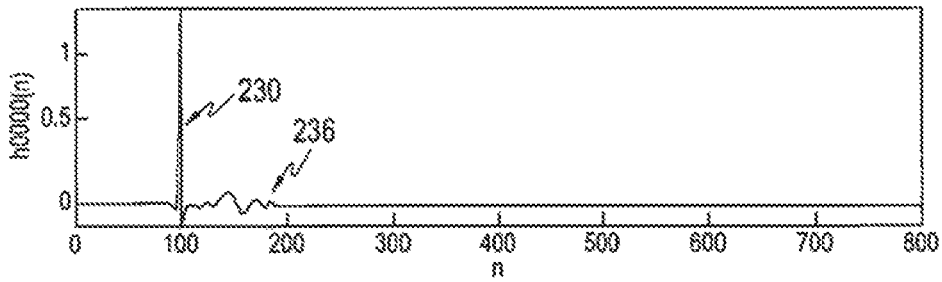

FIGS. 3A to 3C illustrate impulse responses of three frequency-selective echo filters that provide various echo delay times according to the present invention. In FIGS. 3A to 3C, a horizontal axis represents time, and a vertical axis represents an impulse response value. Impulse responses with regard to time are represented by h(n). For example, the horizontal time axis is shown in units of $10^{-6}$ second.

FIG. 3A illustrates impulse response (h1111(n)) characteristics with regard to a first frequency-selective echo filter that provides the longest echo delay time. FIG. 3B illustrates impulse response (h0111(n)) characteristics with regard to a second frequency-selective echo filter that provides a medium echo delay time. FIG. 3C illustrates impulse response (h0000(n)) characteristics with regard to a third frequency-selective echo filter that provides the shortest echo delay time. A time period between an original audio signal 230 and a first frequency-selective echo signal 232 according to a first frequency-selective echo filter is longer than a time period between an original audio signal 230 and the second frequency-selective echo signal 234 according to a second frequency-selective echo filter, and a time period between the original audio signal 230 and a third frequency-selective echo signal 236 according to a third frequency-selective echo filter is shorter than the time period between the original audio signal 230 and the second frequency-selective echo signal 234 according to the second frequency-selective echo filter.

Figure 4A:
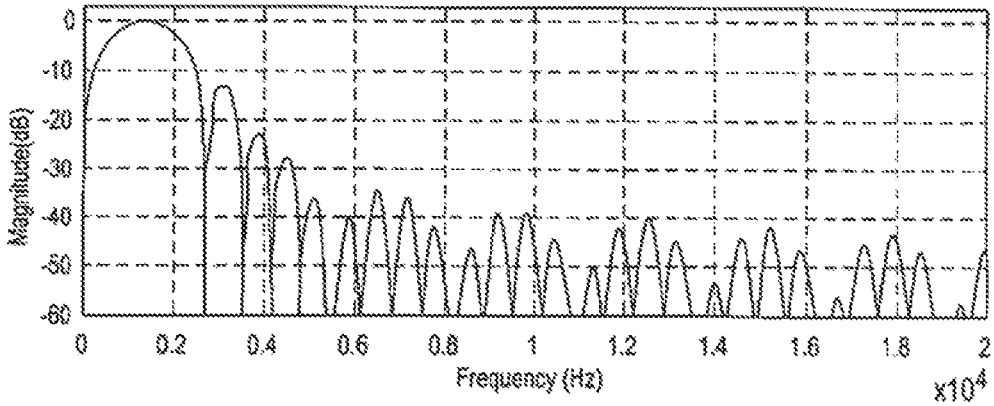
FIGS. 4A and 4B illustrate frequency-amplitude and frequency-phase characteristics of a frequency-selective echo signal.
Figure 4B:
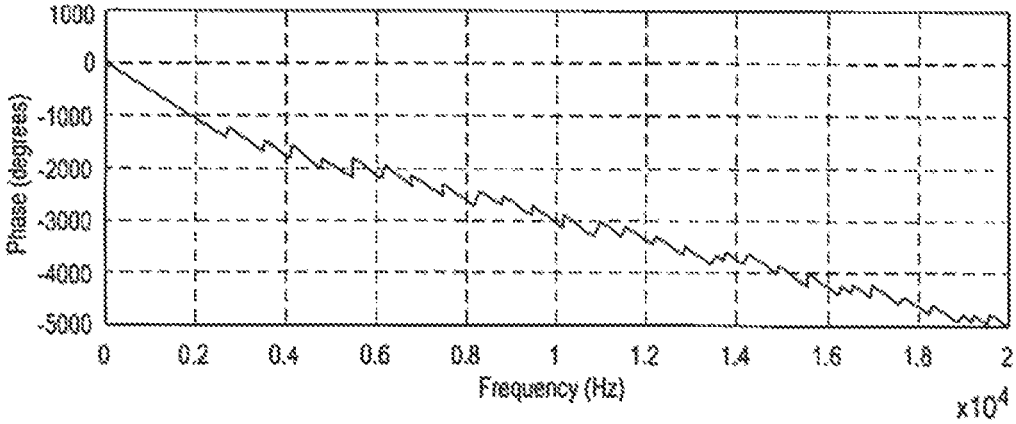

FIGS. 4A and 4B illustrate frequency-amplitude and frequency-phase characteristics of a frequency-selective echo signal. FIG. 4A illustrates a frequency response characteristic of the frequency-selective echo signal. In FIG. 4A, a horizontal axis represents a frequency, and a vertical axis represents a signal strength or magnitude. FIG. 4B illustrates a phase characteristic of the frequency-selective echo signal. In FIG. 4B, a horizontal axis represents a frequency, and a vertical axis represents a signal phase. FIGS. 4A and 4B illustrate that the energy of the frequency-selective echo signals concentrates on a frequency bandwidth of 3 kHz or less.

Figure 5:
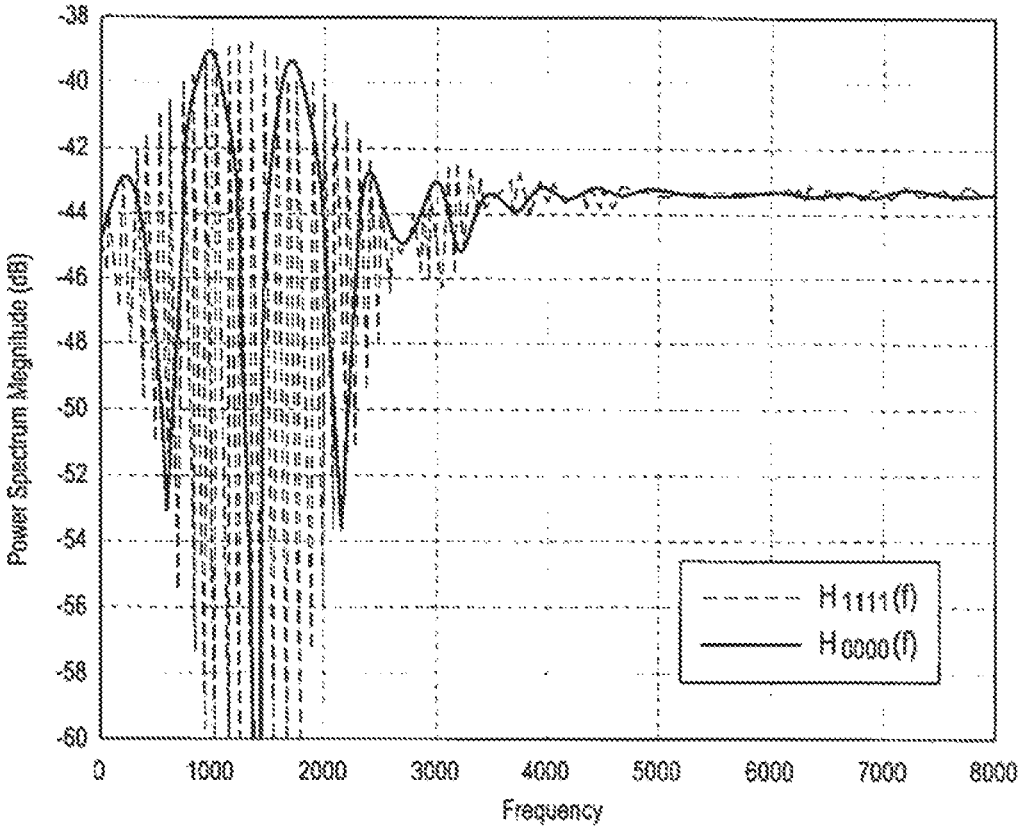
FIG. 5 illustrates a power spectrum of an echo modulated signal according to the present invention.

FIG. 5 illustrates a power spectrum of an echo modulated signal according to the present invention. In FIG. 5, a horizontal axis represents frequency, and a vertical axis represents strength or a magnitude of the power spectrum. The echo modulated signal includes an original audio signal and a frequency-selective echo signal. The echo modulated signals illustrated in FIG. 5 are signals modulated by first and third frequency-selective echo filters providing echo delay times different from each other, and the first and third frequency-selective echo filters have first impulse responses ($H_{1111}(f)$) and a third impulse response ($H_{0000}(f)$) with regard to a frequency f, respectively.

As illustrated in FIG. 5, the echo modulated signal has frequency response ripples in a low frequency region, and the spectrum shape of the echo modulated signal is flat at higher frequencies.

The echo modulated signal with the spectrum shape has the following advantages:

First, audio distortions only occur in a particular frequency region which makes them less audible to a human ear.

Second, spectrum areas, which have not been occupied with an echo signal, can be used to embed a multicarrier signal S or a spread spectrum signal.

In addition, when the distance between the sound source and the microphone is large, the frequency-selective echo modulation according to the present invention has almost the same performance and noise robustness of transfer as conventional echo modulation. This is possible because in such a case high-frequencies are severely attenuated and do not convey useful information.

Figure 6:
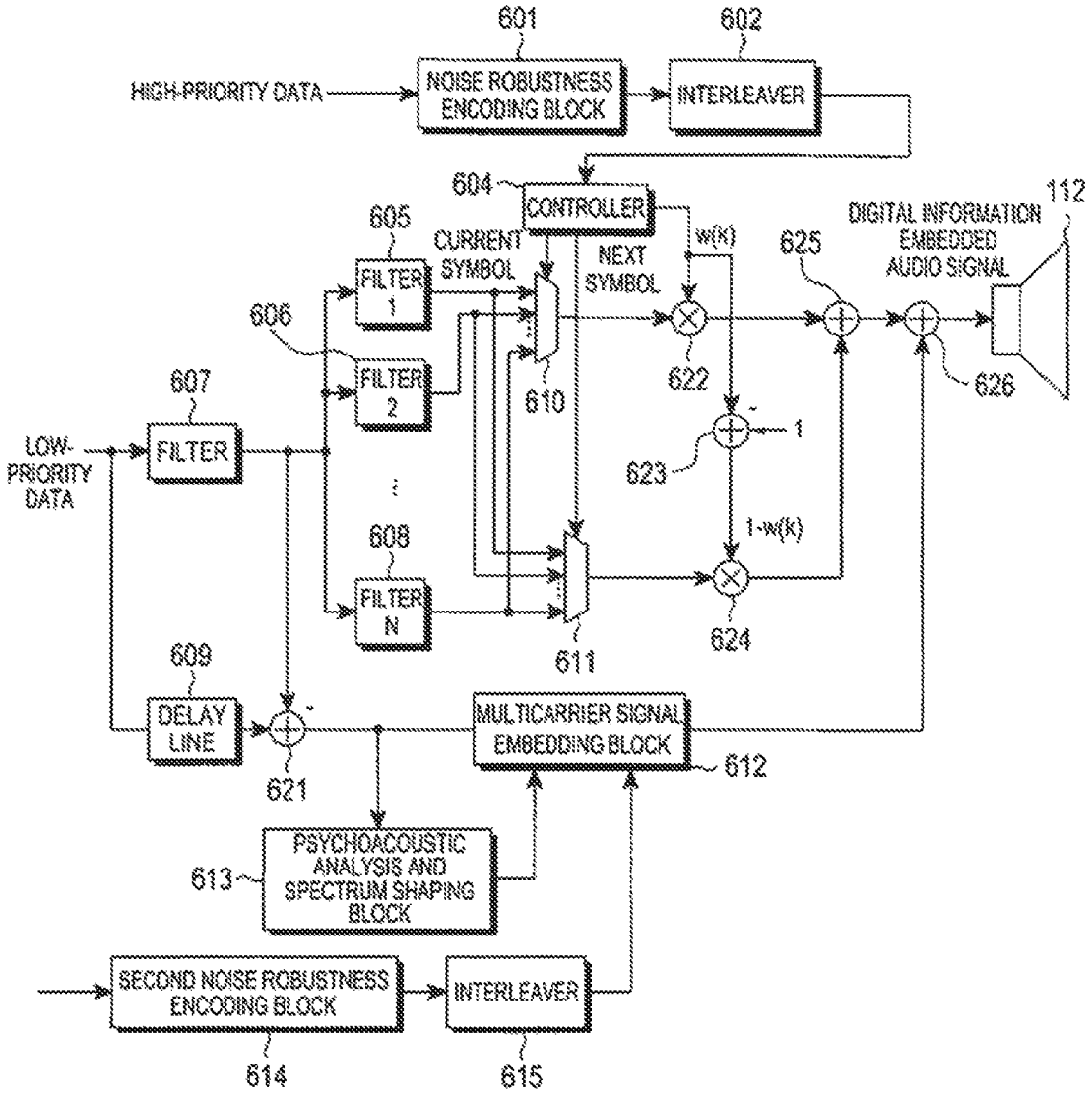
FIG. 6 is a block diagram illustrating a device for embedding digital information into an audio signal according to the present invention.

FIG. 6 illustrates a device for embedding digital information into an audio signal according to the present invention. Such an embedding device (or a modulation device) may be included in a mobile terminal. The embedding device illustrated in FIG. 6 may be referred to as an audio communication device, or a portable, mobile or communication terminal. Such a terminal may be a smart phone, a cell phone, a game console, a TV, a display device, a vehicle head unit, a notebook computer, a laptop computer, a tablet PC, a PMP (Personal Media Player), a PDA (Personal Digital Assistants), or the like. In addition, the embedding device may further include a memory (not illustrated) that stores a program for implementing the embedding method according to the present invention.

The information transmitted by the embedding device is classified into two types of data as follows:

data with a high order of priority (that is, high-priority) consisting of essential information only; and data with a low order of priority (that is, low-priority) consisting of both main and auxiliary, or less essential information.

The high-priority data is embedded into the original audio signal using frequency-selective echo modulation according to the present invention, and the low-priority data is embedded into the original audio signal using multicarrier digital modulation.

The original audio signal is divided into two complementary parts (that is, first and second signal parts or first and second frequency band parts) by a low-frequency bandpass or high-frequency bandpass filter 607, a delay line 609, and the subtractor 621. The frequency bands of the complementary signal parts do not overlap each other.

The bandpass filter 607 passes a low frequency (or high frequency) band part of the original audio signal. The delay line 609 has a length corresponding to a group delay of the bandpass filter 607 (that is, a delay time corresponding to a delay time caused by the bandpass filter 607), and the delay line 609 delays and outputs the original audio signal to subtractor 621. The subtractor 621 subtracts the first signal part from the original audio signal, and outputs the second signal part which is a subtraction result.

The first signal part is modulated by the frequency-selective echo modulation scheme according to the present invention. Such modulation can be implemented by a set of filters 605, 606, and 608, and the filters 605, 606, and 608 have impulse responses similar to response characteristics illustrated in FIGS. 3A to 3C, but provide different values of delay and/or amplitude of echo. Each of the filters 605, 606, and 608 outputs echo modulated signals.

The delay and amplitude in this case represent encoded bits or a particular combination of the bits (that is, bit patterns or symbols). In other words, a particular bit or bits are represented by such a delay and/or amplitude. In order to implement a dynamic modulation scheme, one of the output signals of the filters 605, 606, and 608 at each time instance (that is, a point corresponding to each symbol) in accordance with a current encoded bit pattern is selected by a first multiplexer 610. In the same manner, one of the output signals of the filters 605, 606, and 608 at each time instance (that is, a point corresponding to each symbol) in accordance with a further encoded bit pattern is selected by a second multiplexer 611.

A first noise robustness encoding block 601 encodes the high-priority data using the noise robustness encoding scheme or code (for example, convolutional code, turbo-code, or the like). A first interleaver 602 is used for elimination of a pulse noise effect, and the interleaver 602 outputs bit patterns or symbols obtained by convolutional-interleaving the encoded high-priority data to a controller 604. The controller 604 outputs the current symbol to the first multiplexer 610, and outputs the next symbol to the second multiplexer 611.

It is preferable to make a smooth transition between different bit patterns to reduce audibility of audio distortions. In the present embodiment, for the smooth transition between different bit patterns, the first and second multiplexers 610 and 611 are provided, but only one of the first and second multiplexers 610 and 611 may be provided, if desired. For example, if only the first multiplexer 610 is provided, at each time instance, only the control signal corresponding to the current symbol is input to the first multiplexer 610 from the controller 604. In the illustrated example, the smooth transition between different bit patterns can be performed during the transition interval, during which the filtered output of the first multiplexer 610 corresponding to the current bit pattern or symbol, that is, the strength of the first echo modulated signal, is gradually reduced, while the filtered output of the second multiplexer 611 corresponding to the next bit pattern or symbol, that is, the strength of the second echo modulated signal, is gradually increased in accordance with the smooth function w(k). A first multiplier 622 multiplies the echo modulated signal input from the first multiplexer 610 and the smooth function w(k) input from the controller 604 and outputs the result to a summer 625. A second subtractor 623 subtracts the smooth function w(k) from 1, and outputs the subtraction result, (1−w(k)) to a second multiplier 624. The second multiplier 624 multiplies the echo modulated signal input from the second multiplexer 611 and (1−w(k)) input from the subtractor 623 and outputs the result. For example, the smooth function w(k) has a value decreasing from 1 to 0 during the transition interval. A first summer 625 sums up the first echo modulated signal input from the first multiplier 622 and the second echo modulated signal input from the second multiplier 624, and outputs the final echo modulated signal, that is the sum result, to a second summer 626.

The data with use of multicarrier digital modulation and psychoacoustic masking are added, inserted, or embedded into the second signal part corresponding to the high frequency band part of the original audio signal, preferably containing higher-frequency parts.

A psychoacoustic analysis and spectrum shaping block 613 (or a psychoacoustic modeling block) perform psychoacoustic analysis on the second signal part based on a psychoacoustic model, and in the analysis, a frequency and/or time masking effect is considered. The psychoacoustic analysis and spectrum shaping block 613 produces a spectrum mask on each interval of the analysis reflecting the audible threshold of distortions.

A second noise robustness encoding block 614 encodes low-priority data using a noise robustness encoding scheme or code (for example, convolutional code, turbo-code, or the like). A second interleaver 615 is used for elimination of a pulse noise effect, and the interleaver 615 outputs bit patterns or symbols obtained by convolutional-interleaving the encoded low-priority data to a multicarrier or spread spectrum signal embedding block (hereinafter referred to as a multicarrier signal embedding block) 612.

The multicarrier signal embedding block 612 produces a multicarrier or spread spectrum signal (that is, a noise shaping signal) by applying the spectrum mask input from the psychoacoustic analysis and spectrum shaping block 613 to the symbol input from the second interleaver 615. The multicarrier signal embedding block 612 embeds the multicarrier or spread spectrum signal (that is, the noise shaping signal) to which the spectrum mask is applied into the second signal part.

That is, the multicarrier signal embedding block 612 modulates a noise shaping signal having spectrum according to the psychoacoustic analysis of the second signal part with the low-priority data, and embeds the modulated communication signal (that is, multicarrier signal or multicarrier modulated signal) into the second signal part of the original audio signal.

The second summer 626 sums up the echo modulated signal input from the first summer 625 and the multicarrier modulated signal input from the multicarrier signal embedding block 612, and outputs the audio signal into which the digital information is embedded (or the audio signal modulated with digital information), that is the sum result, to a speaker 112. The speaker 112 outputs the audio signal into which the digital information is embedded as an audio signal.

A device for acoustic communication disclosed in US Patent Publication No. 2011/0144979 may be used as an embodiment of the multicarrier modulation device 612 to 615 and is incorporated herein by reference according to the present invention.

Figure 7:
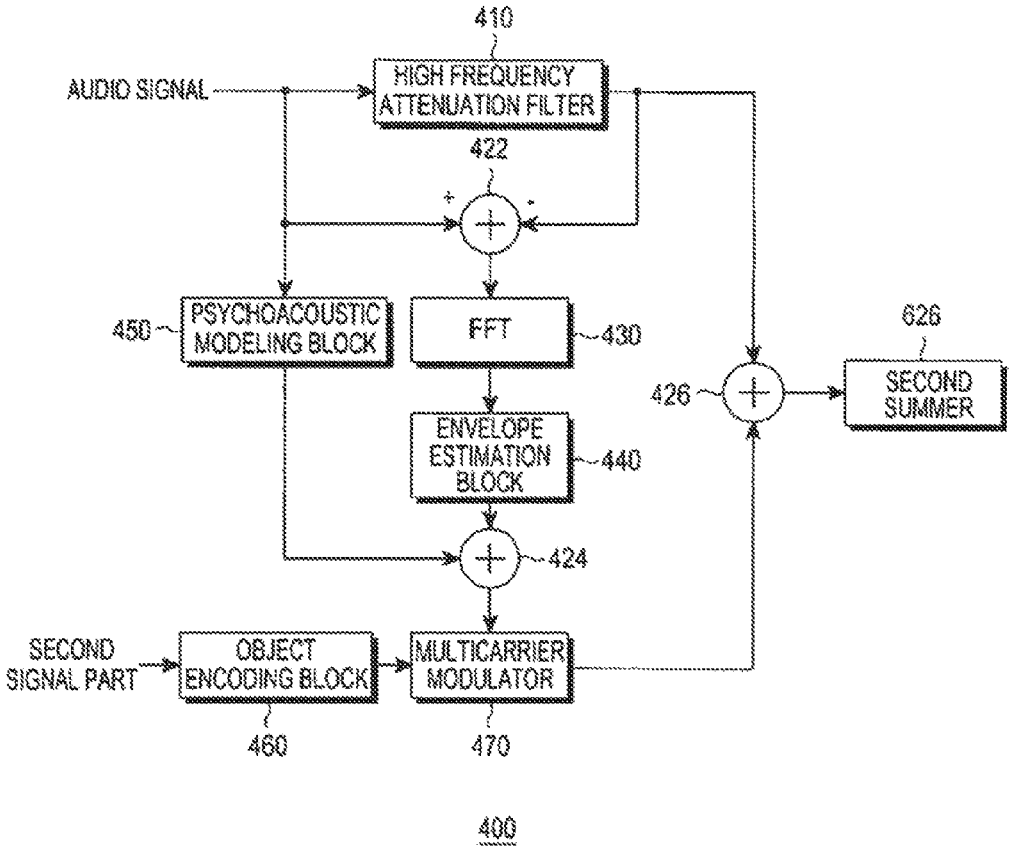
FIG. 7 is a block diagram illustrating an embodiment of a multicarrier modulation device.

FIG. 7 illustrates an embodiment of the multicarrier modulation device.

The device 400 includes a high frequency attenuation filter 410, a first combiner 422, an FFT block 430, a envelope estimation block 440, a psychoacoustic modeling block 450, a second combiner 424, an object encoding block 460, a multicarrier modulator 470, and a third combiner 426. The psychoacoustic modeling block 450 corresponds to the psychoacoustic analysis and spectrum shaping block 613 illustrated in FIG. 6, the object encoding block 460 corresponds to a combination of the second noise robustness encoding block 614 and the second interleaver 615 as illustrated in FIG. 6, and the other components of the device 400 correspond to the multicarrier signal embedding block 612 as illustrated in FIG. 6.

The high frequency attenuation filter 410 has filter response characteristics, so that spectral energy in the medium frequency and high frequency region is gradually reduced. The high frequency attenuation filter 410 passes most signals in the low frequency region without any change and gradually reduces the signals in the medium and high frequency region.

The second signal part is filtered by the high frequency attenuation (or high-shelf) filter 410. There is no steep cut-off frequency in the filter response characteristics. Therefore, the spectral distortions introduced by the high frequency attenuation filter 410 are less annoying to the human ear.

The second signal part and the filtered signal are input to the first combiner 422, which outputs a difference (that is, a residual signal) between the second signal part and the filtered signal.

The FFT block 430 performs the FFT on the residual signal. In other words, the FFT block 430 converts the residual signal in the time domain into a signal in the frequency domain. The envelope estimation block 440 analyzes the converted residual signal and estimates (or detects) the envelope which is the spectral shape of the residual signal. The psychoacoustic modeling block 450 calculates a psychoacoustic mask from the signal of the second signal part according to the common psychoacoustic model.

An absolute audibility threshold shows the threshold strength distribution of each frequency that the human ear has difficulty hearing in a quiet atmosphere. The masker is the frequency bin having a considerably large signal strength compared with nearby frequency bins (maskees) in the second signal part. Without the masker, the maskees exceeding the absolute audibility threshold can be heard. The maskees (that is, small sounds) are veiled by the masker (that is, a large sound), so that the maskees cannot be heard. This effect is referred to as a masking effect. Reflecting such a masking effect, the actual audibility threshold for the masks rises (or increases) over the absolute audibility threshold, with the rising audibility threshold referred to as the frequency masking threshold. In other words, the frequency bins below the frequency masking threshold are not heard.

The psychoacoustic mask calculated by the psychoacoustic modeling block 450 corresponds to the difference between the frequency masking threshold and the second signal part.

The second combiner 424 combines the first mask (that is, the residual spectrum) input from the envelope estimation block 440 with the second mask, (that is, the psychoacoustic mask for the second signal part) input from the psychoacoustic modeling block 450 and generates the final acoustic signal spectrum mask, and then outputs the generated spectrum mask to the multicarrier modulator 470. The final spectrum mask is used for generating the spectrum of the second signal part.

The acoustic signal spectrum mask corresponds to the sum of the psychoacoustic mask and the residual signal.

The object encoding block 460 encodes and outputs the input digital data. For example, the object encoding block 460 can perform Quadrature Amplitude Modulation (QAM).

The multicarrier modulator 470 performs multicarrier modulation on the encoded digital data (that is, symbols) according to the acoustic signal spectrum mask input from the second combiner 424, and outputs the resultant signal. For example, the multicarrier modulator 470 can perform Orthogonal Frequency Division Multiplexing (OFDM) in which the symbols input from the object encoding block 460 are multiplexed by the frequency bins in the spectrum mask input from the second combiner 424, and then the resultant values are combined and output. The multicarrier and spread spectrum signal output from the multicarrier modulator 470 includes a frequency spectrum similar to that included in the spectrum mask.

The third combiner 426 combines the filtered signal input from the high frequency attenuation filter 410 with the multicarrier and spread spectrum signal output from the multicarrier modulator 470, and the multicarrier modulated signal, which is the sum result, is output to the second summer 626.

The method for embedding digital information into an audio signal according to the present invention may be implemented as a specific hardware module based on a semiconductor element, or may be implemented by a mobile or portable device, or a personal computer or software for a server.

The circuit decoding the embedded signal by the method may be implemented by a hardware module or an embedded software for a mobile or portable device. Various algorithms may be used for decoding data embedded into the audio signal by using the methods of the present invention.

Figure 8:
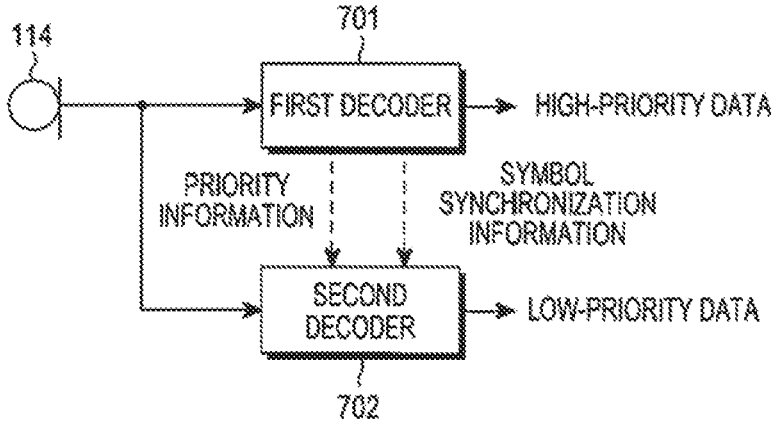
FIG. 8 is a block diagram illustrating a device for decoding digital information encoded from an audio signal according to the present invention.

FIG. 8 illustrates a device for decoding digital information encoded from an audio signal according to the present invention. The decoding device may be mounted on a portable, mobile or communication terminal including the embedding device as described above.

The decoding device includes a common microphone 114 for receiving or capturing an audio signal over the air and first and second decoders 701 and 702, which are two connected modules for decoding low-priority or high-priority data. For example, the first decoder 701 decodes high-priority data from an audio signal by a reverse process of a frequency-selective echo modulation process, and the second decoder 702 decodes low-priority data from an audio signal by a reverse process of a multicarrier modulation process.

In a part modulated by the frequency-selective echo modulation, the transition of the symbols synchronizes with the transition of symbols in the multicarrier modulation device. In general, the high-priority data may be decoded in a more complicated noise state, and in such case, additional information (that is, symbol synchronization information) for synchronizing the second decoder 702 for the low-priority data with the first decoder 701 and priority information with regard to some data bits (for example, information for primarily decoding some data bits) may be provided from the first decoder 701 to the second decoder 702.

The present invention may be additionally used in a location-based application that can embed location information into an audio signal. In such a case, the high-priority information may contain longitude and latitude coordinates only, whereas the low-priority information may contain additional information such as a venue name, tips, web-links and other information.

Figure 9:
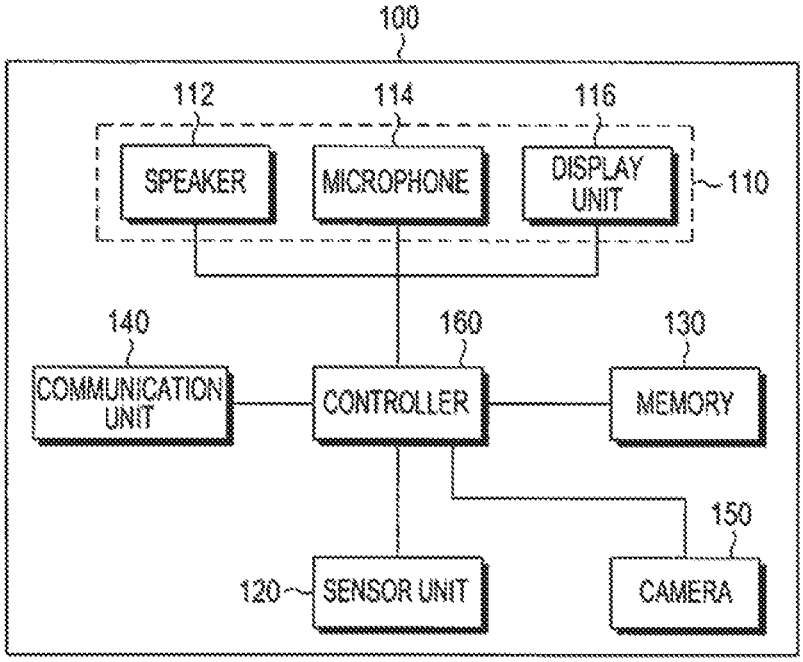
FIG. 9 is a block diagram illustrating a configuration of a communication terminal according to an embodiment of the present invention.

FIG. 9 is a block diagram illustrating a configuration of a communication terminal according to an embodiment of the present invention. The communication terminal 100 may be a smart phone, a cell phone, a game console, a TV, a display device, a vehicle head unit, a notebook computer, a laptop computer, a tablet PC, a PMP (Personal Media Player), a PDA (Personal Digital Assistant), or the like.

The communication terminal 100 may include a user interface 110 including a speaker 112, a microphone 114, and a display unit 116, a sensor unit 120, a memory 130, a communication unit 140, a camera 150, and a controller 160. In addition, the communication terminal 100 may further include a key pad including a plurality of buttons, a mouse, or the like.

In the embedding device illustrated in FIG. 6, all the other component elements except the speaker 112 are incorporated in a controller, and the first and second decoders 701 and 702 are also incorporated in the controller illustrated in FIG. 8.

The speaker 112 outputs data input from the controller 160 as an audio signal over the air, and the microphone 114 outputs an audio signal received from over the air to the controller 160.

The display unit 116 displays an image according to an image signal input from the controller 160 and at the same time receives user input data to output the user input data to the controller 160. The display unit 116 may include a display unit such as an LCD (Liquid Crystal Display), an OLED (Organic Light Emitting Diodes), an LED, or the like, and a touch panel mounted under or over the display unit. The touch panel detects user input.

The sensor unit 120 detects a state, a location, a direction, a movement, or a surrounding environment state of the communication terminal 100. In addition, the sensor unit 120 includes at least one sensor. For example, a sensor module may include a proximity sensor that detects whether a user is near the communication terminal 100, a motion/direction sensor that detects the operation (for example, rotation, acceleration, retardation, vibration, or the like of the communication terminal 100) or a position (or a direction) of the communication terminal 100, and/or an illuminance sensor that detects illumination intensity of the surroundings or the combination thereof. In addition, the motion/direction sensor may include at least one of an acceleration sensor, a gravity sensor, a terrestrial magnetism sensor, a gyro sensor, a shock sensor, a GPS sensor, a compass sensor, and an acceleration sensor.

The memory 130 stores an operating system of the communication terminal 100, various applications, information, data, files, or the like which are input to the communication terminal 100, and information, data, files, or the like produced therein. Especially, the memory 130 stores a program for implementing a method for embedding digital information into an audio signal or a method for decoding digital information from an audio signal.

The communication unit 140 transmits messages, data, files, or the like generated by the controller 160 by wire or wirelessly or receives messages, data, files, or the like by wire or wirelessly and outputs the messages, the data, the files or the like to the controller 160.

The camera 150 may include a lens system, an image sensor, a flash, or the like. The camera converts a light signal input (or captured) through the lens system into an electric image signal and outputs the electric image signal to the controller, and the user can capture a moving image or a still image by the camera.

The controller 160 is a central processing unit (CPU) or a processor, which controls overall operations of the communication terminal 100, and executes a method for embedding digital information into an audio signal, or a method for decoding digital information from an audio signal.

Figure 10:
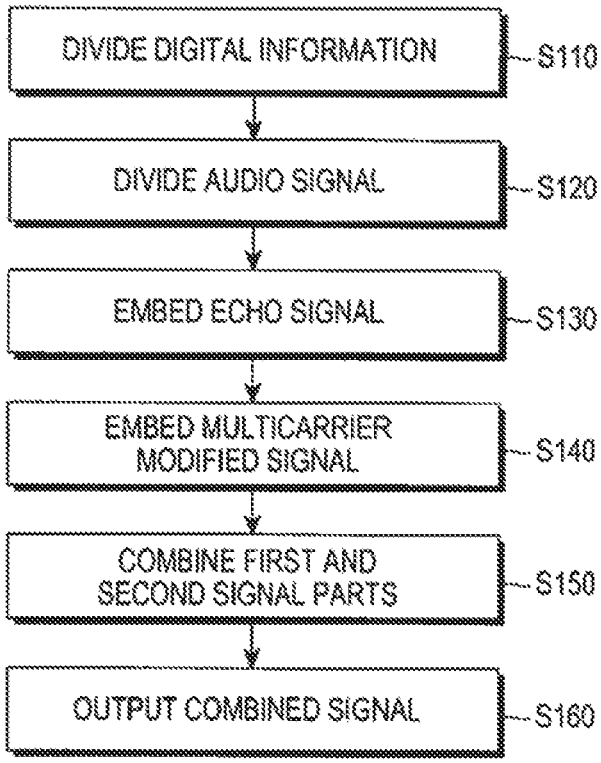
FIG. 10 is a flowchart illustrating a method for embedding digital information into an audio signal by using a communication terminal as illustrated in FIG. 9.

FIG. 10 is a flowchart illustrating a method for embedding digital information to an audio signal by using a communication terminal as illustrated in FIG. 9.

Digital information is divided in step S110, and the controller 160 divides digital information into low-priority data or high-high priority data. Such digital information is data stored in the memory 130, or data received by the communication unit 140.

An audio signal is divided in step S120, and the controller 160 divides an original audio signal into the first and second signal parts. Preferably, the first signal part corresponds to a low frequency band part of the audio signal, and the second signal part corresponds to a high frequency band part of the audio signal. Otherwise, the first signal part corresponds to the high frequency band part of the audio signal, and the second signal part may correspond to the low frequency band part of the audio signal.

An echo signal is embedded in step S130, and the controller 160 embeds at least one echo signal into the first signal part. Compared with an audio signal, an echo signal is delayed in time and has a low impulse response value (that is, strength).

A multicarrier modulated signal is embedded in step S140, and the controller 160 has a spectrum according to psychoacoustic analysis of the second signal part, and the communication signal modulated with low-priority data (that is, multicarrier modulated signal) is embedded into the second signal part.

The embedded first and second signal parts are combined in step S150, and the controller 160 combines the first signal part into which an echo signal is embedded and the second signal part into which a multicarrier modulated signal is embedded.

In step S160, the combined signal is output, and the controller 160 outputs the combined first and second signal parts through the speaker 112.

The present invention can optimize the use capacity of an outdoor sound channel for data transmission. Especially, if the distance between a sound source and a microphone, which is a reception device, is relatively short, the present invention enables the sound channel to have the highest data transmission rate. If the distance between the sound source and the microphone increases, the data transmission rate gradually decreases. If the distance between the sound source and the microphone considerably increases, or there is an obstacle in a sound transmission route, the present invention enables the digital data to be transmitted as a sound though the transmission rate somewhat decreases.

It is understood that the embodiments of the present invention can be realized in a form of hardware, software, or a combination thereof. Such arbitrary software can be stored on a volatile or non-volatile storage device such as a ROM, a memory such as a RAM, a memory chip, a memory device, or an integrated circuit, or a storage medium that is optically or magnetically recordable and machine-readable (for example, computer-readable) such as a CD, a DVD, a magnetic disc, or a magnetic tape regardless of whether it is deletable or rewritable. The memory that can be included in a portable, mobile, or communication terminal is an example of a program including instructions for implementing the embodiments according to the present invention or a machine-readable storage medium appropriate for storing programs. Therefore, the present invention includes a program including codes for implementing a device or a method described in the claims of the present disclosure, or a machine-readable storage medium for storing the program. In addition, the program can be electronically transferred via any media such as communication signals transmitted by a wire or wireless connection, and the present invention appropriately includes the equivalents thereof.

In addition, the portable, mobile, or communication terminal may receive the program from the program providing device connected by wire or wirelessly or store the received program. The program providing device may include a program including instructions for executing a method in which the portable, mobile, or communication terminal embeds digital information into an audio signal or a method for decoding digital information from an audio signal, a memory for storing other information, data, or the like, a communication unit for performing a wired or wireless communication with the portable, mobile, or communication terminal, and a controller for transmitting a corresponding program to the portable, mobile, or communication terminal automatically or at a request of the portable, mobile, or communication terminal.

While the present invention has been shown and described with reference to certain embodiments thereof, it will be understood by those skilled in the art that various changes in form and details may be made therein without departing from the spirit and scope of the present invention as defined by the appended claims.

What is claimed is:

1. A method for embedding digital information into an audio signal, the method comprising:

dividing the digital information into low-priority data and high-priority data;

dividing the audio signal into first and second signal parts;

embedding at least one echo signal into the first signal part;

embedding a communication signal modulated with low-priority data, which has a spectrum according to psychoacoustic analysis of the second signal part, into the second signal part; and combining the embedded first and second signal parts.

2. The method for embedding digital information into an audio signal according to claim 1, wherein the modulated communication signal is a multicarrier modulated signal.

3. The method for embedding digital information into an audio signal according to claim 1, wherein the first signal part into which the echo signal is embedded belongs to a frequency band lower than the second signal part.

4. The method for embedding digital information into an audio signal according to claim 1, wherein the first signal part into which the echo signal is embedded belongs to a frequency band higher than the second signal part.

5. The method for embedding digital information into an audio signal according to claim 1, wherein the combined first and second signal parts are output through a speaker.

6. A machine-readable storage device containing a program for executing a method for embedding digital information into an audio signal, the method comprising:

dividing the digital information into low-priority data and high-priority data;

dividing the audio signal into first and second signal parts;

embedding at least one echo signal into the first signal part;

embedding a communication signal modulated with low-priority data, which has a spectrum according to psychoacoustic analysis of the second signal part, into the second signal part; and combining the embedded first and second signal parts.

7. A communication terminal for embedding digital information into an audio signal, the communication terminal comprising:

a memory for storing the digital information and the audio signal;

a controller configured to divide the digital information into low-priority data and high-priority data, divide the audio signal into first and second signal parts, embed at least one echo signal into the first signal part, embed a communication signal modulated with low-priority data, which has a spectrum according to psychoacoustic analysis of the second signal part, into the second signal part, and combine the embedded first and second signal parts; and a speaker for outputting the combined first and second signal parts.

8. The communication terminal according to claim 7, wherein the modulated communication signal is a multicarrier modulated signal.

9. The communication terminal according to claim 7, wherein the first signal part into which the echo signal is embedded belongs to a frequency band lower than the second signal part.

10. The communication terminal according to claim 7, wherein the first signal part into which the echo signal is embedded belongs to a frequency band higher than the second signal part.

* * * * *